US009856873B2

(12) United States Patent
Shimono et al.

(10) Patent No.: US 9,856,873 B2
(45) Date of Patent: Jan. 2, 2018

(54) VANE PUMP

(71) Applicant: KAYABA INDUSTRY CO., LTD., Tokyo (JP)

(72) Inventors: Hiromi Shimono, Gifu (JP); Tomoyuki Fujita, Gifu (JP); Masamichi Sugihara, Gifu (JP); Yoshiyuki Maki, Gifu (JP)

(73) Assignee: KYB Corporation, Tokyo (JP)

( * ) Notice: Subject to any disclaimer, the term of this patent is extended or adjusted under 35 U.S.C. 154(b) by 114 days.

(21) Appl. No.: 14/768,673

(22) PCT Filed: Feb. 26, 2014

(86) PCT No.: PCT/JP2014/054613
§ 371 (c)(1),
(2) Date: Aug. 18, 2015

(87) PCT Pub. No.: WO2014/132977
PCT Pub. Date: Sep. 4, 2014

(65) Prior Publication Data

US 2015/0377236 A1 Dec. 31, 2015

(30) Foreign Application Priority Data

Feb. 26, 2013 (JP) ..... 2013-035615

(51) Int. Cl.
*F01C 1/00* (2006.01)
*F03C 2/00* (2006.01)
(Continued)

(52) U.S. Cl.
CPC ..... *F04C 15/0061* (2013.01); *F01C 21/108* (2013.01); *F04C 2/344* (2013.01); *F04C 2/3448* (2013.01); *F04C 15/06* (2013.01)

(58) Field of Classification Search
CPC ..... F04C 2/102; F04C 11/008
(Continued)

(56) References Cited

U.S. PATENT DOCUMENTS 3,102,494 A * 9/1963 Adams ..... F01C 21/0863 418/268
5,466,137 A * 11/1995 Bierlein ..... F04C 15/0023 418/132
(Continued)

FOREIGN PATENT DOCUMENTS

JP 63-104689 A 7/1988
JP H02-43485 U 3/1990
(Continued)

*Primary Examiner* — Mark Laurenzi
*Assistant Examiner* — Deming Wan
(74) *Attorney, Agent, or Firm* — Rabin & Berdo, P.C.

(57) ABSTRACT

The vane pump includes a rotor, a plurality of slits, vanes that are respectively received in the slits, a cam ring that has an inner circumferential cam face with which tip portions of the vanes are brought into sliding contact, pump chambers that are defined by the rotor, the cam ring, and the adjacent vanes, a side member that has a sliding contact surface with which the side surface of the rotor is brought into sliding contact, a discharge port that is formed so as to open to the side member, the discharge port being configured to guide working fluid discharged from the pump chamber, and a notch that are provided on the side member so as to extend from the opening of the discharge port in direction opposite to rotating direction of the rotor. The notch is formed radially outside of the protruded portion of the rotor.

2 Claims, 3 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 15/00*** | (2006.01) |
| ***F04C 29/00*** | (2006.01) |
| ***F01C 21/00*** | (2006.01) |
| ***F04C 2/344*** | (2006.01) |
| ***F04C 15/06*** | (2006.01) |
| ***F01C 21/10*** | (2006.01) |

(58) Field of Classification Search
USPC ..... 418/268, 80, 81, 79, 269, 133
See application file for complete search history.

(56) References Cited

U.S. PATENT DOCUMENTS

| | | | | |
|---|---|---|---|---|
| 6,120,256 | A | 9/2000 | Miyazawa | |
| 6,877,969 | B2 * | 4/2005 | Yao | F04C 18/3446 418/133 |
| 7,628,596 | B2 * | 12/2009 | Staton | F01C 21/0863 418/133 |
| 2004/0202565 | A1 | 10/2004 | Yao et al. | |
| 2009/0291008 | A1 | 11/2009 | Uchida et al. | |

FOREIGN PATENT DOCUMENTS

| | | | |
|---|---|---|---|
| JP | 10-030580 | A | 2/1998 |
| JP | 11-303773 | A | 11/1999 |
| JP | 2001-248569 | A | 9/2001 |
| JP | 2001-248569 | A | 9/2001 |
| JP | 2004-092395 | A | 3/2004 |
| JP | 2004-308605 | A | 11/2004 |
| JP | 2005-036686 | A | 2/2005 |
| JP | 2005-120892 | A | 5/2005 |
| JP | 2005-120893 | A | 5/2005 |
| JP | 2005-120894 | A | 5/2005 |
| JP | 2009-138672 | A | 6/2009 |
| JP | 2010-031715 | A | 2/2010 |
| JP | 2010-196682 | A | 9/2010 |
| JP | 2012-137047 | A | 7/2012 |
| WO | WO-2008/038638 | A1 | 4/2008 |

* cited by examiner

VANE PUMP

TECHNICAL FIELD

The present invention relates to a vane pump used as a fluid pressure source in a fluid pressure apparatus.

BACKGROUND ART

A vane pump includes a rotor that receives vanes, a cam ring that has an inner circumferential cam face with which tip portions of the vanes are brought into sliding contact, and a side plate that is in sliding contact with one end side of the rotor in the axial direction. A discharge port is formed on the side plate, and this discharge port is for guiding working fluid discharged from pump chambers that are defined by the rotor, the cam ring, and the adjacent vanes.

JP2001-248569A discloses that a notch, which is a groove, is formed on a side plate so as to extend from an opening portion of a discharge port in the direction opposite to the rotating direction of a rotor. With such a configuration, when the rotor is rotated to supply/discharge the working fluid, the pump chamber is opened to the notch before opening to the discharge port, and thereby, the high-pressure working fluid is supplied through the notch from the discharge port to the pump chamber that is positioned rearward in the rotating direction. Thus, because it is possible to gradually increase the pressure in the pump chamber before the pump chamber is pressurized to a high pressure, it is possible to suppress rapid pressure variation in the pump chamber.

SUMMARY OF INVENTION

However, when air contained in working fluid is supplied to a pump chamber through a notch, there is a risk that it is not possible to sufficiently increase the pressure in the pump chamber in advance, and rapid pressure variation is caused in the pump chamber.

An object of the present invention is to provide a vane pump that is capable of suppressing supply of air to a pump chamber through a notch.

According to one aspect of the present invention, a vane pump includes a rotor that is rotationally driven by motive power from a motive-power source; a plurality of slits that have openings on an outer circumference of the rotor and that are formed in a radiating pattern, the openings being provided on protruded portions that are protruded from the outer circumference of the rotor; vanes that are respectively received in the slits in a freely slidable manner; a cam ring that has an inner circumferential cam face with which tip portions of the vanes are brought into sliding contact, the tip portions being end portions of the vanes in direction projecting out from the slits; pump chambers that are defined by the rotor, the cam ring, and the adjacent vanes; a side member that has a sliding contact surface with which the side surface of the rotor is brought into sliding contact; a discharge port that is formed so as to open to the side member, the discharge port being configured to guide working fluid discharged from the pump chamber; and a notch that are provided on the side member so as to extend from the opening of the discharge port in direction opposite to rotating direction of the rotor; wherein the notch is formed radially outside of the protruded portion of the rotor.

DESCRIPTION OF EMBODIMENT

Described below is an embodiment of the present invention with reference to the accompanied drawings.

Figure 1:
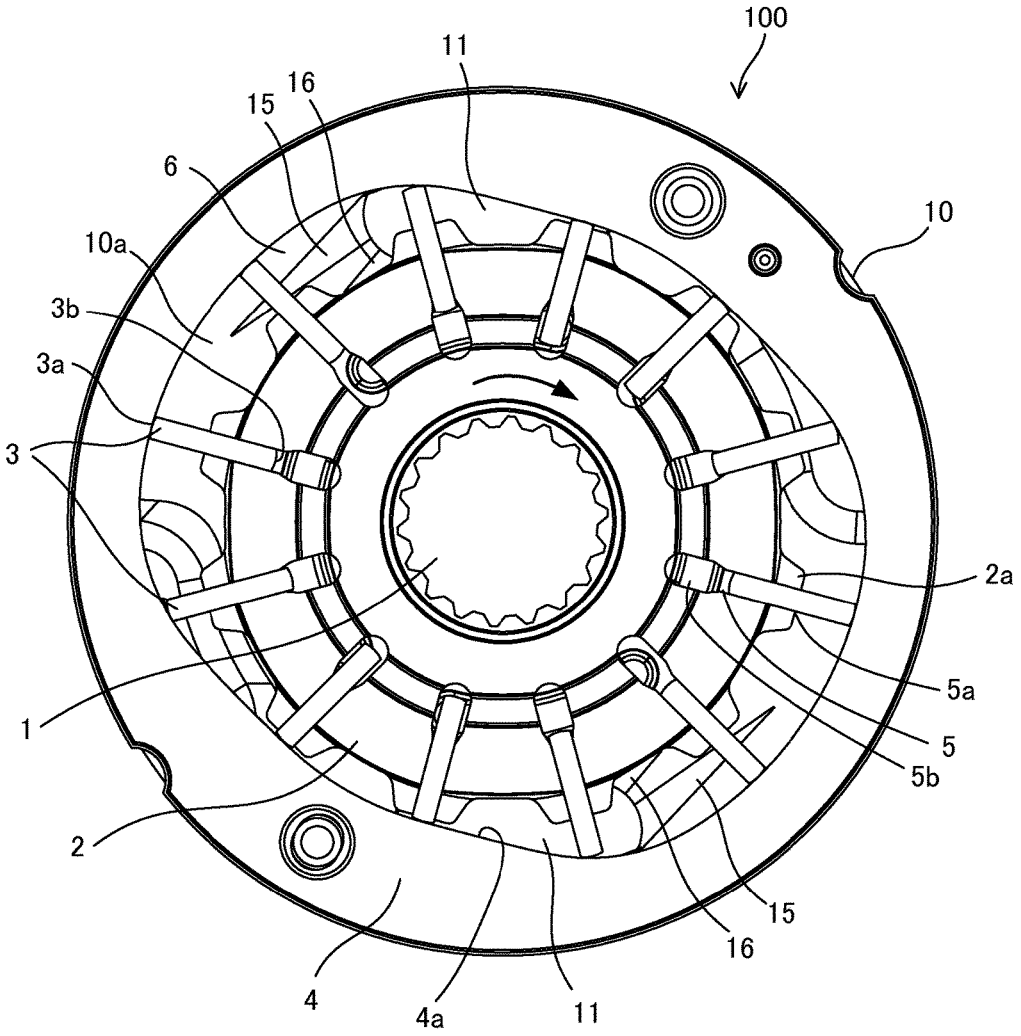
FIG. 1 is a front view of a vane pump according to an embodiment of the present invention, and is a diagram showing a state in which a pump cover has been removed.

FIG. 1 is a front view of a vane pump 100 according to this embodiment, and is a diagram showing a state in which a pump cover has been removed. In FIG. 1, in order to simplify the description, illustration of a pump body is omitted.

The vane pump 100 is used as a fluid pressure source for a fluid pressure apparatus mounted on a vehicle. The fluid pressure apparatus includes, for example, a power steering apparatus, a continuously variable transmission, or the like. Oil, aqueous alternative fluid of other type, or the like may be used as working fluid.

The vane pump 100 is driven by an engine (not shown) etc., for example, and generates fluid pressure as a rotor 2 that is linked to a drive shaft 1 is rotated clockwise as shown by an arrow in FIG. 1.

The vane pump 100 includes the drive shaft 1 that is rotatably supported by a pump body, the rotor 2 that is rotationally driven by being linked to the drive shaft 1, a plurality of vanes 3 that are provided so as to be capable of reciprocating in the radial direction relative to the rotor 2, and a cam ring 4 that accommodates the rotor 2 and the vanes 3.

In the rotor 2, a plurality of slits 5 individually having opening portions 5*a* on the outer circumferential surface of the rotor 2 are formed in a radiating pattern with predetermined gaps therebetween. The opening portions 5*a* of the slits 5 are formed as protruded portions 2*a* that protrude radially outwards from the outer circumference of the rotor 2. In other words, the number of the protruded portions 2*a* formed on the outer circumference of the rotor 2 corresponds to that of the slits 5.

The vanes 3 are respectively inserted into the slits 5 in a freely slidable manner, and have tip portions 3*a* that are end portions in the directions projecting out from the slits 5 and base-end portions 3*b* that are end portions at the opposite sides of the tip portions 3*a*. At the base-end sides of the slits 5, back pressure chambers 5*b* that are defined by the base-end portions 3*b* of the vanes 3 and to which the working fluid is guided are respectively formed. The vanes 3 are pushed in the directions projecting out from the slits 5 by the pressure of the back pressure chambers 5*b*.

The cam ring 4 is an annular member having an inner circumferential cam face 4*a* serving as the inner circumferential surface having substantially oval shape. As the vanes 3 are pressed in the directions projecting out from the slits 5 by the pressure of the back pressure chambers 5*b*, the tip portions 3*a* of the vanes 3 are brought into sliding contact with the inner circumferential cam face 4*a* of the cam ring 4. With such a configuration, pump chambers 6 are defined within the cam ring 4 by the outer circumferential surface of the rotor 2, the inner circumferential cam face 4*a* of the cam ring 4, and the adjacent vanes 3.

Because the inner circumferential cam face 4*a* of the cam ring 4 has a substantially oval shape, the volumes of the pump chambers 6, which are defined between the respective vanes 3 that slide at the inner circumferential cam face 4*a* by the rotation of the rotor 2, are repeatedly expanded and contracted. The working fluid is sucked in regions in which the pump chambers 6 are expanded, and the working fluid is discharged in regions in which the pump chambers 6 are contracted.

In the pump body, a pump accommodating concaved portion (not shown) accommodating the cam ring 4 is formed. A side plate 10 serving as a side member that is in sliding contact with the rotor 2 and that abuts with the cam ring 4 is arranged on a bottom surface of the pump accommodating concaved portion (see FIG. 2). An opening portion of the pump accommodating concaved portion is closed with the pump cover (not shown) that is in sliding contact with the rotor 2 and that abuts with the cam ring 4. The pump cover and the side plate 10 are arranged on both side surfaces of the rotor 2 and the cam ring 4 in a state facing against each other.

On the sliding contact surface of the pump cover that is in sliding contact with the rotor 2, two arc-shaped suction ports (not shown) are formed so as to open corresponding to the regions in which the pump chambers 6 are expanded and to guide the working fluid to the pump chambers 6. In addition, on a sliding contact surface 10*a* of the side plate 10 that is in sliding contact with the rotor 2, two arc-shaped discharge ports 11 (see FIG. 2) are formed so as to open in corresponding to the regions in which the pump chambers 6 are contracted, and to discharge the working fluid from the pump chambers 6.

Figure 2:
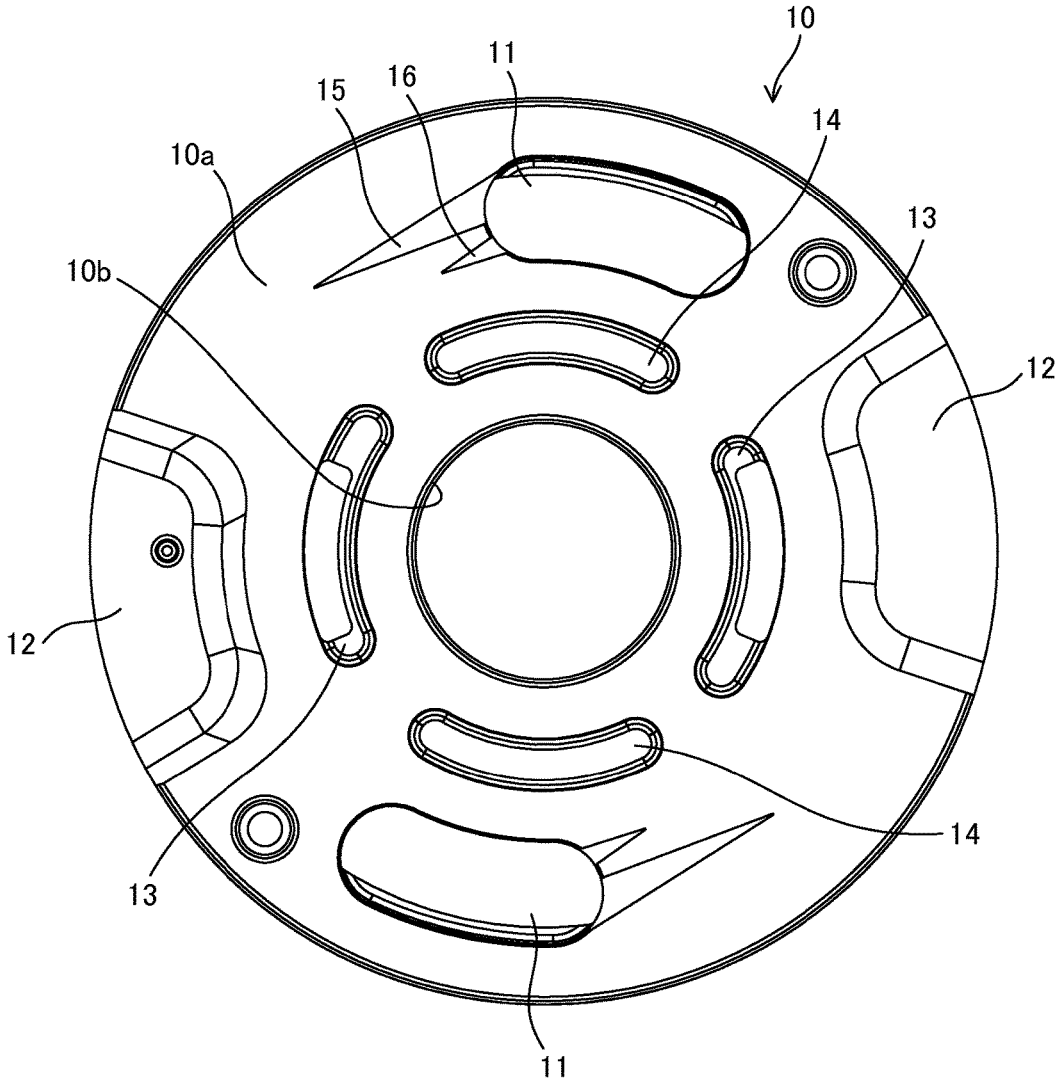
FIG. 2 is a front view of a side plate.

FIG. 2 is a front view of the side plate 10.

The side plate 10 has the sliding contact surface 10*a* that is in sliding contact with the side surface of the rotor 2 and a through hole 10*b* into which the drive shaft 1 is inserted and fitted. The side plate 10 further has suction concaved portions 12 that are formed on the sliding contact surface 10*a* at positions corresponding to the suction ports of the pump cover, and the discharge ports 11 that are formed so as to open to the sliding contact surface 10*a* and to discharge the working fluid in the pump chambers 6 and guide it to the fluid pressure apparatus.

The suction concaved portions 12 are arranged along the circumferential direction of the side plate 10 in the two regions in which the pump chambers 6 are expanded, respectively. The outer circumference edges of the respective suction concaved portions 12 are formed so as to reach the outer circumference edge of the side plate 10 and to have a concaved shape that opens radially outwards.

The discharge ports 11 are arranged along the circumferential direction of the side plate 10 in the two regions in which the pump chambers 6 are contracted, respectively. The respective discharge ports 11 are formed to have an arc shape centered at the through hole 10*b* of the side plate 10.

The side plate 10 further has suction-side back pressure ports 13 that are formed so as to open to the sliding contact surface 10*a* to communicate with the back pressure chambers 5*b* in the regions in which the pump chambers 6 are expanded, and discharge-side back pressure ports 14 that are formed so as to open to the sliding contact surface 10*a* to communicate with the back pressure chambers 5*b* in the regions in which the pump chambers 6 are contracted.

The suction-side back pressure ports 13 are formed so as to have an arc shape centered at the through hole 10*b* in the regions in which the pump chambers 6 are expanded. The discharge-side back pressure ports 14 are formed so as to have an arc shape centered at the through hole 10*b* in the regions in which the pump chambers 6 are contracted.

In addition, the pump cover has suction ports that are formed so as to open to the sliding contact surface with the rotor 2 to guide the working fluid into the pump chambers 6 and the concaved portions for discharge (not shown) that are formed on a sliding contact surface at positions corresponding to the discharge ports 11 of the side plate 10.

The suction ports are arranged along the circumferential direction of the pump cover in the two regions in which the pump chambers 6 are expanded. The individual suction ports are formed so as to have an arc shape centered at the through hole of the pump cover. The concaved portions for discharge are arranged along the circumferential direction of the pump cover in the two regions in which the pump chambers 6 are contracted. The individual concaved portions for discharge are formed so as to have an arc shape centered at the through hole of the pump cover.

The suction ports are in communication with a tank (not shown) through a suction passage (not shown) formed in the pump cover, and the working fluid in the tank is supplied to the pump chambers 6 from the suction ports of the pump cover through the suction passage. The discharge ports 11 are provided so as to penetrate through the side plate 10 and to communicate with a high-pressure chamber (not shown) that is formed in the pump body. The high-pressure chamber is in communication with the fluid pressure apparatus outside the vane pump 100 through a discharge passage (not shown).

A vane pump 200 according to a comparative example will be described below.

Figure 3:
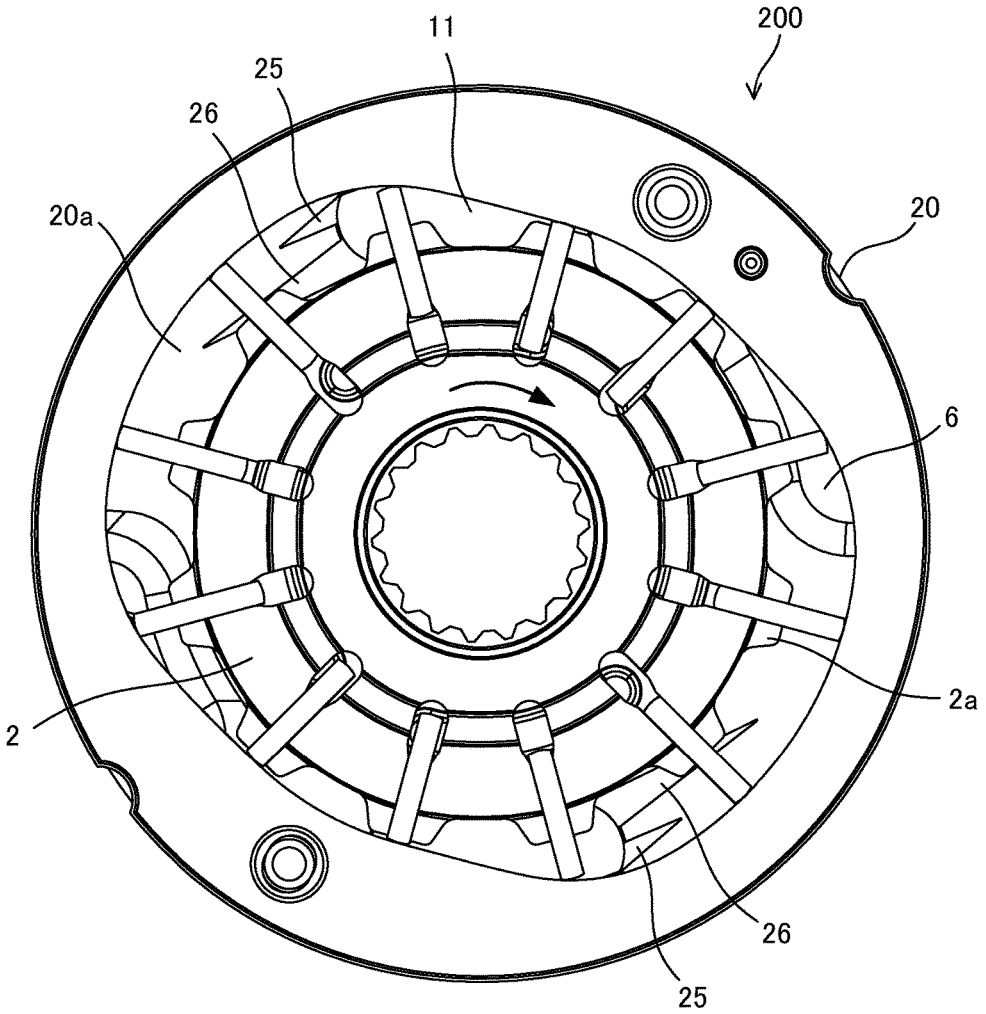
FIG. 3 is a front view of a vane pump according to a comparative example, and is a diagram showing a state in which a pump cover has been removed.

FIG. 3 is a front view of the vane pump 200 according to the comparative example, and is a diagram showing a state in which a pump cover has been removed. In FIG. 3, configurations that are the same as those in the present embodiment are assigned the same reference signs and description thereof shall be omitted.

With the vane pump 200 according to the comparative example, outer notches 25 and inner notches 26 that are grooves extending from the openings of the discharge ports 11 in the direction opposite to the rotating direction of the rotor 2 are formed on a sliding contact surface 20*a* of a side plate 20. The outer notches 25 are arranged at the outer circumferential side of the inner notches 26, and have shorter lengths than those of the inner notches 26 in the rotating direction of the rotor 2.

The outer notches 25 and the inner notches 26 are both formed so as to have a tapered shape that narrows in the dimension in the radial direction of the rotor 2 towards the direction opposite to the rotating direction of the rotor 2 from the openings of the discharge ports 11. In addition, the outer notches 25 and the inner notches 26 are arranged at positions between the outer circumferential side of the outer circumferential surface of the rotor 2 excluding the protruded portions 2*a* and the inner circumferential side of the inner circumferential cam face 4*a* of the cam ring 4.

With such a configuration, as the rotor 2 rotates, the pump chamber 6 opens to the inner notch 26 and the outer notch 25 in this order before it opens to the discharge port 11, and thereafter, the pump chamber 6 opens to the discharge ports 11. As the outer notch 25 and the inner notch 26 are opened to the pump chamber 6, the high-pressure working fluid in the discharge port 11 is introduced to the pump chamber 6 that is positioned rearward of the discharge port 11 in the rotating direction. Thus, before the pump chamber 6 opens to the discharge port 11, the pressure in the pump chamber 6 is gradually increased, and thereby, it is possible to suppress the rapid pressure variation in the pump chamber 6.

However, in a case where air is contained in the working fluid, and in particular, where the rotation speed of the rotor 2 is high, the working fluid in the pump chamber 6 is forcedly moved towards the outer circumferential side due to a centrifugal force caused by the rotation of the rotor 2, thus, air that is less dense than the working fluid is accumulated at the inner circumferential side. The air accumulated at the inner circumferential side is introduced to the pump chamber 6 positioned rearward in the rotating direction mainly through the inner notch 26. If the air is introduced to the pump chamber 6 positioned rearward in the rotating direction, the pressure in the pump chamber 6 cannot be increased sufficiently due to the compressibility of air. With such a configuration, because the pump chamber 6 is caused to communicate with the discharge port 11 in a state not sufficiently pressurized, the pressure in the pump chamber 6 is increased rapidly, causing greater pressure variation therein.

Thus, in this embodiment, as shown in FIGS. 1 and 2, outer notches 15 and inner notches 16 are formed such that the lengths of the outer notches 15 in the rotating direction of the rotor 2 are longer than those of the inner notches 16.

The outer notches 15 and the inner notches 16 are arranged at positions between the outer circumferential side of the outer circumferential surface of the rotor 2 excluding the protruded portions 2*a* and the inner circumferential side of the inner circumferential cam face 4*a* of the cam ring 4. The outer notches 15 are always arranged radially outside of the protruded portions 2*a* of the rotor 2 regardless of the rotation angle of the rotor 2. The inner notches 16 are always arranged inside of most-outer circumferential portions of the protruded portions 2*a* of the rotor 2 regardless of the rotation angle of the rotor 2.

With such a configuration, as the rotor rotates, the pump chamber opens to the outer notch 15 first, and then to the inner notch 16. Therefore, in a case where air is contained in the working fluid, and in particular, where the rotation speed of the rotor 2 is high, the working fluid that is forcedly moved towards the outer circumferential side due to the centrifugal force caused by the rotation of the rotor 2 is introduced to the pump chamber 6 positioned rearward in the rotating direction through the outer notch 15 before the air that is forcedly moved towards the inner circumferential side. With such a configuration, the high-pressure working fluid is introduced to the pump chamber 6 positioned rearward in the rotating direction. Thus, it is possible to gradually increase the pressure in the pump chamber 6 before the pump chamber 6 communicates with the discharge port 11, thereby suppressing the rapid pressure variation caused by insufficient pressurization in the pump chamber 6.

According to the embodiment mentioned above, the advantages described below are afforded.

Because the outer notch 15 is formed radially outside of the protruded portion 2*a* of the rotor 2, it is possible to suppress introduction of the air that is forcedly moved towards space between the protruded portions 2*a* on the inner circumferential side due to the centrifugal force caused by the rotation of the rotor 2 into the pump chamber 6 positioned rearward in the rotating direction, and it is possible to positively introduce the working fluid into the pump chamber 6. Therefore, because it is possible to reliably increase the pressure in the pump chamber 6 before the pump chamber 6 communicates with the discharge port 11, the rapid pressure variation in the pump chamber 6 can be suppressed.

In addition, by suppressing the pressure variation in the pump chamber 6, it is possible to maintain the pump performance even if the vane pump 100 is operated in a state in which an air content rate in the working fluid is high and the rotation speed of the rotor 2 is high.

Furthermore, because the inner notch 16 is provided radially inside of the outer notch 15 and the length of the inner notch 16 in the rotating direction of the rotor 2 is shorter than that of the outer notch 15, it is possible to make the outer notch 15 to communicate with the pump chamber 6 before the inner notch 16. Thus, it is possible to positively introduce the working fluid forcedly moved to the outer circumferential side due to the centrifugal force caused by the rotation of the rotor 2 into the pump chamber 6.

In addition, because the pump chamber 6 communicates with the inner notch 16 in addition to the outer notch 15 immediately before the pump chamber 6 communicates with the discharge port 11, it is possible to increase the amount of the working fluid to be introduced into the pump chamber 6 and to pressurize the pump chamber 6 further.

Furthermore, because the inner notch 16 is formed inside of the most-outer circumferential portions of the protruded portions 2*a* of the rotor 2, even if air is contained in the working fluid that is to be introduced from the discharge port 11 to the pump chamber 6 through the inner notch 16, the air is supplied into the air forcedly moved towards the space between the adjacent protruded portions 2*a* in the pump chamber 6 due to the centrifugal force caused by the rotation of the rotor 2, and thus, the pressure in the pump chamber 6 is less likely to be varied. Thus, it is possible to suppress the pressure variation in the pump chamber 6.

Embodiments of this invention were described above, but the above embodiments are merely examples of applications of this invention, and the technical scope of this invention is not limited to the specific constitutions of the above embodiments.

For example, in the above-mentioned embodiment, although the fixed displacement vane pump 100 has been illustrated, the vane pump may be of a variable displacement type.

Furthermore, in the above-mentioned embodiment, although the inner notches 16 are provided on the inner circumferential side of the outer notches 15, the inner notches 16 may not be provided.

Furthermore, in the above-mentioned embodiment, although the total of two notches, namely, the outer notch 15 and the inner notch 16, are respectively provided, more than two notches may be provided in the radial direction of the rotor in an arbitrary order.

Furthermore, in the above-mentioned embodiment, although the notches 15 and 16 are respectively provided so as to extend from the openings of the discharge ports 11 on the sliding contact surface 10*a* of the side plate 10, the notches 15 and 16 may be respectively formed so as to extend from the openings of the concaved portions for discharge on the sliding contact surface of the pump cover. In this case, the pump cover corresponds to the side member according to claim 1. In addition, the individual notches 15 and 16 may be formed on both of the sliding contact surface 10*a* of the side plate 10 and the sliding contact surface of the pump cover.

This application claims priority based on Japanese Patent Application No. 2013-035615 filed with the Japan Patent Office on Feb. 26, 2013, the entire contents of which are incorporated into this specification.

The invention claimed is:

1. A vane pump used as a fluid pressure source comprising:

a rotor that is rotationally driven by motive power from a motive-power source;

a plurality of slits that have openings on an outer circumference of the rotor and that are formed in a radiating pattern, the openings being provided on protruded portions that are protruded from the outer circumference of the rotor;

vanes that are respectively received in the slits in a freely slidable manner;

a cam ring that has an inner circumferential cam face with which tip portions of the vanes are brought into sliding contact, the tip portions being end portions of the vanes in direction projecting out from the slits;

pump chambers that are defined by the rotor, the cam ring, and the adjacent vanes;

a side member that has a sliding contact surface with which the side surface of the rotor is in sliding contact;

a discharge port that is formed so as to open to the side member, the discharge port being configured to guide working fluid discharged from the pump chamber;

a notch that are provided on the side member so as to extend from the opening of the discharge port in direction opposite to rotating direction of the rotor; and an inner notch that is formed radially inside the notch, wherein the notch is formed radially outside of the protruded portion of the rotor, the inner notch is formed inside a most-outer circumferential portion of the protruded portion of the rotor, a length of the inner notch in rotating direction of the rotor is shorter than that of the notch, and the notch, the inner notch and the discharge port are so arranged that the pump chamber opens to the notch, the inner notch and the discharge port, sequentially in this order, as the rotor rotates.

2. The vane pump according to claim 1, wherein the inner notch is inside the most-outer circumferential portion of the protruded portion of the rotor regardless of a rotation angle of the rotor.

* * * * *